US010822905B2

(12) United States Patent
Sonnier et al.

(10) Patent No.: US 10,822,905 B2
(45) Date of Patent: Nov. 3, 2020

(54) MILLING APPARATUS WITH STABILIZATION FEATURE

(71) Applicants: James Sonnier, Houston, TX (US); Anthony Zavesky, Houston, TX (US)

(72) Inventors: James Sonnier, Houston, TX (US); Anthony Zavesky, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 17 days.

(21) Appl. No.: 16/145,547

(22) Filed: Sep. 28, 2018

(65) Prior Publication Data

US 2020/0102801 A1 Apr. 2, 2020

(51) Int. Cl.
*E21B 29/00* (2006.01)
*E21B 29/06* (2006.01)
*E21B 31/00* (2006.01)

(52) U.S. Cl.
CPC ..... *E21B 29/005* (2013.01); *E21B 29/06* (2013.01); *E21B 31/002* (2013.01)

(58) Field of Classification Search
CPC ..... E21B 29/005
USPC ..... 166/55.7
See application file for complete search history.

(56) References Cited

U.S. PATENT DOCUMENTS 5,373,900 A 12/1994 Lynde et al.
8,555,955 B2 10/2013 Davis
2010/0288491 A1 11/2010 Cochran et al.
2012/0152543 A1* 6/2012 Davis ..... E21B 10/66 166/298
2014/0124202 A1* 5/2014 Beynon ..... E21B 29/005 166/298
2015/0096753 A1 4/2015 Kulage
2015/0101812 A1 4/2015 Bansal et al.
2016/0348455 A1 12/2016 Haq et al.

OTHER PUBLICATIONS

International Search Report for International Application No. PCT/US2019/053348; dated Jan. 15, 2020; 3 pages.
Written Opinion for International Application No. PCT/US2019/053348; dated Jan. 15, 2020; 5 pages.

* cited by examiner

*Primary Examiner* — Taras P Bemko
(74) *Attorney, Agent, or Firm* — Cantor Colburn LLP

(57) ABSTRACT

An apparatus for removing at least a section of a tubular includes an axially elongated body configured to be advanced through an inner tubular in a borehole to a selected location, the inner tubular disposed within an outer tubular in the borehole and having a diameter that is less than a diameter of the outer tubular. The apparatus also includes a cutter configured to be actuated between a closed position in which the cutter is disposed within the body and an open position in which the cutter extends radially, the cutter having a length sufficient to engage and cut the outer tubular, the cutter configured to be advanced in an axial cutting direction as the outer tubular is cut. The apparatus further includes an automatic stabilization member disposed on the cutter, the stabilization member configured to restrict lateral movement of the cutter by contacting the outer tubular during cutting.

20 Claims, 6 Drawing Sheets

MILLING APPARATUS WITH STABILIZATION FEATURE

BACKGROUND

In the resource recovery industry, milling tools, or mills, are used to perform cutting tasks within a subterranean borehole. Milling tools are often employed to cut away discrete objects within or associated with a borehole. For example, a milling tool may be used to cut through junk, a plug or other obstruction in a borehole. Milling tools can also be used to enlarge a borehole or cut a tubular such as a casing, to open a window.

In some cases, such as during plug and abandonment (P&A) operations, it is desirable to deploy a milling tool and mill a window through a section of a casing or other tubular in order to seal off a formation (or zone). Often a borehole includes multiple casings or other tubulars, and it becomes necessary to mill multiple windows. For example, in a section of wellbore having an inner casing and an outer casing, it may be necessary to cut a first window in the inner casing, and thereafter mill a second window in the outer casing through the first window. This can present a challenge for stabilization of the milling tool.

SUMMARY

An embodiment of an apparatus for removing at least a section of a tubular includes an axially elongated body configured to be advanced through an inner tubular in a borehole in an earth formation to a selected location, the inner tubular disposed within an outer tubular in the borehole and having a diameter that is less than a diameter of the outer tubular. The apparatus also includes a cutter configured to be actuated between a closed position in which the cutter is disposed within the body and an open position in which the cutter extends radially, the cutter having a length sufficient to engage and cut the outer tubular, the cutter configured to be advanced in an axial cutting direction as the outer tubular is cut. The apparatus further includes an automatic stabilization member disposed on the cutter, the stabilization member configured to restrict lateral movement of the cutter by contacting the outer tubular during cutting of the outer tubular.

An embodiment of a method of removing at least a section of a tubular includes advancing an apparatus having an axially elongated body through an inner tubular in a borehole in an earth formation to a selected location, the inner tubular disposed within an outer tubular in the borehole and having a diameter that is less than a diameter of the outer tubular, the apparatus having a cutter. The method also includes actuating the cutter from a closed position in which the cutter is disposed within the body and an open position in which the cutter extends radially, the cutter having a length sufficient to engage and cut the outer tubular, the cutter having an automatic stabilization member disposed on the cutter to restrict lateral movement of the cutter during cutting of the outer tubular. The method further includes rotating the apparatus and advancing the cutter in an axial cutting direction to remove at least a section of the outer tubular, and restricting lateral movement of the cutter by the stabilization member by contacting the outer tubular during cutting of the outer tubular.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
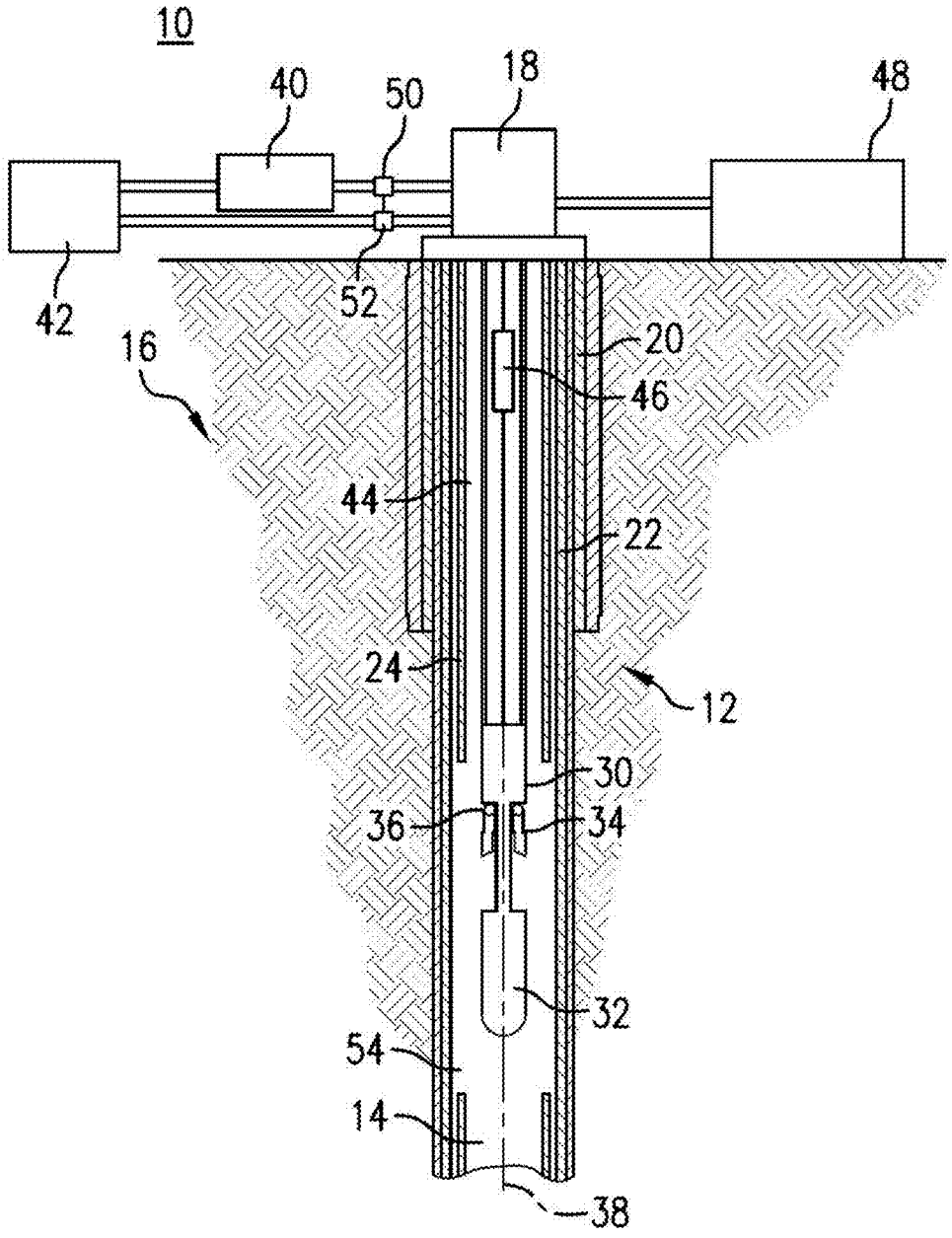
FIG. 1 depicts an embodiment of a drilling and/or resource production system that includes a milling apparatus having one or more extendable milling knives.

Referring to FIG. 1, an embodiment of a well milling and/or production system 10 includes a borehole string 12 that is shown disposed in a well or borehole 14 that penetrates at least one earth formation 16 during a drilling, milling or other downhole operation. As described herein, "borehole" or "wellbore" refers to a hole that makes up all or part of a drilled well. It is noted that the borehole 14 may include vertical, deviated and/or horizontal sections, and may follow any suitable or desired path. As described herein, "formations" refer to the various features and materials that may be encountered in a subsurface environment and surround the borehole 14. Although a milling and production system is shown in FIG. 1, embodiments described herein may be suitable in a variety of energy industry systems and processes, such as drilling, stimulation, measurement and/or completion systems and processes.

A surface structure or surface equipment 18 includes or is connected to various components such as a wellhead, derrick and/or rotary table for performing various functions, such as supporting the borehole string 12, deploying the borehole string 12 (including desired tools and components) into the borehole 14, rotating the borehole string 12, communicating with downhole components, performing surface measurements and/or performing downhole measurements. In one embodiment, the borehole string 12 is a drill string including one or more drill pipe sections or coiled tubing that extends downward into the borehole 14.

The borehole may include a plurality of tubulars, such as casing strings, liners, measurement tools, bypass tools and others. For example, as shown in FIG. 1, the borehole 12 includes a surface casing 20, an outer tubular such as an outer casing 22 and an inner tubular such as an inner casing 24. The tubulars shown in FIG. 1 are not limited to casings, but can be any suitable tubular. For example, the inner casing 24 may instead be a production string.

The system 10 also includes a milling apparatus 30 (also referred to as a milling tool 30) that can perform various functions, such as cutting or removing downhole components, enlarging a borehole (underreaming) and cutting a section of casing to drill a secondary borehole from the borehole 12.

The milling tool 30 includes an axially elongated body 32, also referred to as a housing 32, that supports one or more cutters 34. Each cutter is movable to extend the cutter away from the housing into an annulus to cut, mill grind or otherwise remove at least a section of the outer casing 22. In one embodiment, the cutters 34 are configured as milling knives, and are referred to as milling knives 34. Each milling knife 34 is actuatable to extend the milling knife 34 radially from the housing 32. For example, each milling knife 34 is rotatable about a pivot point 36 to move the milling knife 34 from a closed position in which the milling knife 34 is disposed within the housing 32 to an open position in which the milling knife 34 is rotated (e.g., by about 90 degrees or less) to extend cutting portions of the milling knife 34 into an annulus. Once extended, the milling tool 30 is rotated and moved in an axial direction to remove a section of a tubular. The expandability and retraction of the cutters 34 (e.g., the milling knives 34) allows passage through a restricted section of a borehole to a location for cutting a tubular.

An "axial" direction or an "axially extending" component refers to a direction or component that is at least partially parallel to a central axis 38 of the axially elongated tool body, the borehole string 12 and/or the borehole 14.

The milling tool 30 can be driven from the surface and/or downhole. For example, the borehole string 12 can be rotated by the surface equipment 18, or the milling tool 30 can be rotated by a downhole motor or mud motor. Flow properties of fluid circulated through the mud motor, such as pressure and flow rate, can be controlled to control the speed of the mud motor.

The surface equipment 18 includes components to facilitate circulating fluid such as drilling mud through the string 12 and/or a mud motor. For example, a pumping device 40 is located at the surface to circulate fluid from a mud pit or other fluid source 42 into the borehole 14. Fluid is pumped through a conduit such an interior bore of the borehole string 12, then exits the borehole string 12 and travels upward through an annulus 44 of the borehole 14 (e.g., between the borehole string 12 and the borehole wall) and returns to the surface. If the borehole 14 includes a cased section, the annulus 44 is defined by the exterior of the borehole string 12 and a casing (e.g., the outer casing 22 or the inner casing 24).

In one embodiment, one or more downhole components and/or one or more surface components may be in communication with and/or controlled by a processor such as a downhole processor 46 and/or a surface processing unit 48. In one embodiment, the surface processing unit 48 is configured as a surface control unit which controls various parameters such as rotary speed, weight-on-bit, fluid flow parameters (e.g., pressure and flow rate) and others.

Surface and/or downhole sensors or measurement devices may be included in the system 10 for measuring and monitoring aspects of an operation, fluid properties, component characteristics and others. In one embodiment, the surface processing unit 48 and/or the downhole processor 46 includes or is connected to various sensors for measuring fluid flow characteristics. For example, the system 10 includes fluid pressure and/or flow rate sensors 50 and 52 for measuring fluid flow into and out of the borehole 12, respectively. Fluid flow characteristics may also be measured downhole, e.g., via fluid flow rate and/or pressure sensors in the borehole string 12.

In one embodiment, the milling tool 30 is configured to mill a section of a tubular from a restricted section of the borehole 12. For example, as shown in FIG. 1, a section of the inner casing 24 has been milled, forming a first window 54 (also referred to as an inner window 54 or a primary window 54) in the inner casing 24. The milling tool 30 in this example is configured to mill a section of the outer casing 22 through the first window 54. Because the milling tool 30 is configured to cut the outer casing 22 but needs to be able to be run within the inner casing 24, the housing 32 has a diameter or size such that the milling tool 30 can be run through the inner casing 24 (i.e., the restricted section), while the milling knife 34 (or knives 34) is long enough to extend to or beyond the outer casing 22.

As a result, when milling through the first window 54, there is a relatively wide gap between the tool housing 32 and the outer casing 22. This can present a challenge for stabilization of the milling tool 30 during operation due to the restriction. For example, the milling tool 30 can exhibit significant lateral movement while advancing through the borehole, which can reduce the efficiency of the milling tool 30 and cause damage to the tool 30.

Referring to FIGS. 2-5, the milling tool 30 includes an automatic stabilization feature 60, such as a stabilization member 62 or 64 (discussed below), on each milling knife 34, to stabilize the milling tool 30 during operation. The automatic stabilization feature 60 allows the tool 30 to enter the first window 54, and cut out a section of the outer casing 22 through the restriction without exhibiting significant lateral movement or vibration (e.g., wobbling).

Embodiments of the milling tool 30 and the stabilization feature 60 are shown in FIGS. 2-5. In these embodiments, the milling tool 30 includes the body 32 (e.g., a cylindrical body) having the central axis 38, and forms a central bore or conduit 70 that allows fluid to flow through the milling tool 30 from other components of the borehole string 12.

The milling tool 30 also includes an actuation assembly 72 configured to cause the milling knife 34 to rotate about the pivot point 36 between a closed position and an open position. The actuation assembly includes a hydraulic actuator 74 that can be operated automatically or by an operator or controller (e.g., the surface processing unit 48) to move a piston or actuator member 76.

Figure 2:
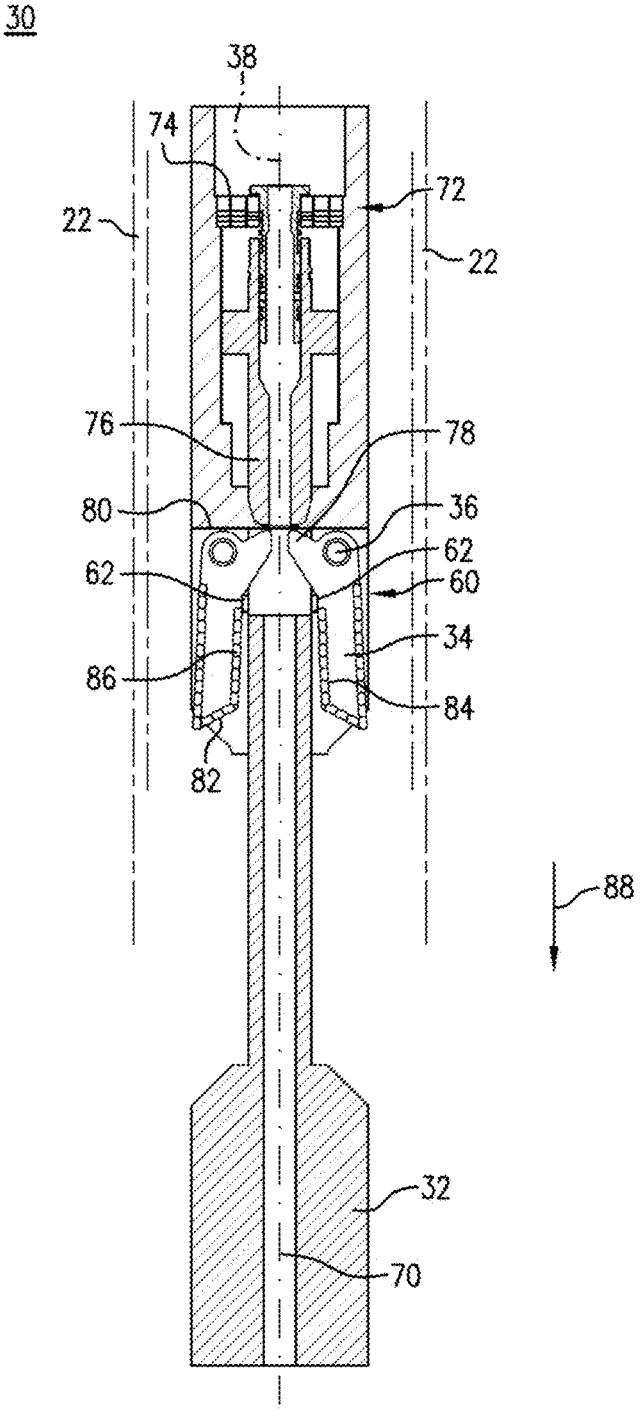
FIG. 2 depicts an embodiment of the milling apparatus of FIG. 1 in a closed position.

In the closed position, shown in FIG. 2, the actuator member 76 is in a first position and each milling knife 34 is folded into or otherwise disposed within the housing 32, so that each milling knife 34 does not extend laterally beyond the exterior surface of the housing 32, or at least so that each milling knife 34 does not extend laterally beyond the radial location of the inner casing 24 when disposed in the inner casing 24. For example, the milling knives 34 can extend slightly past the exterior of surface of the housing 32 as long as the milling tool 30 fits through the inner casing 24 without causing damage to the milling knives 34.

Figure 3:
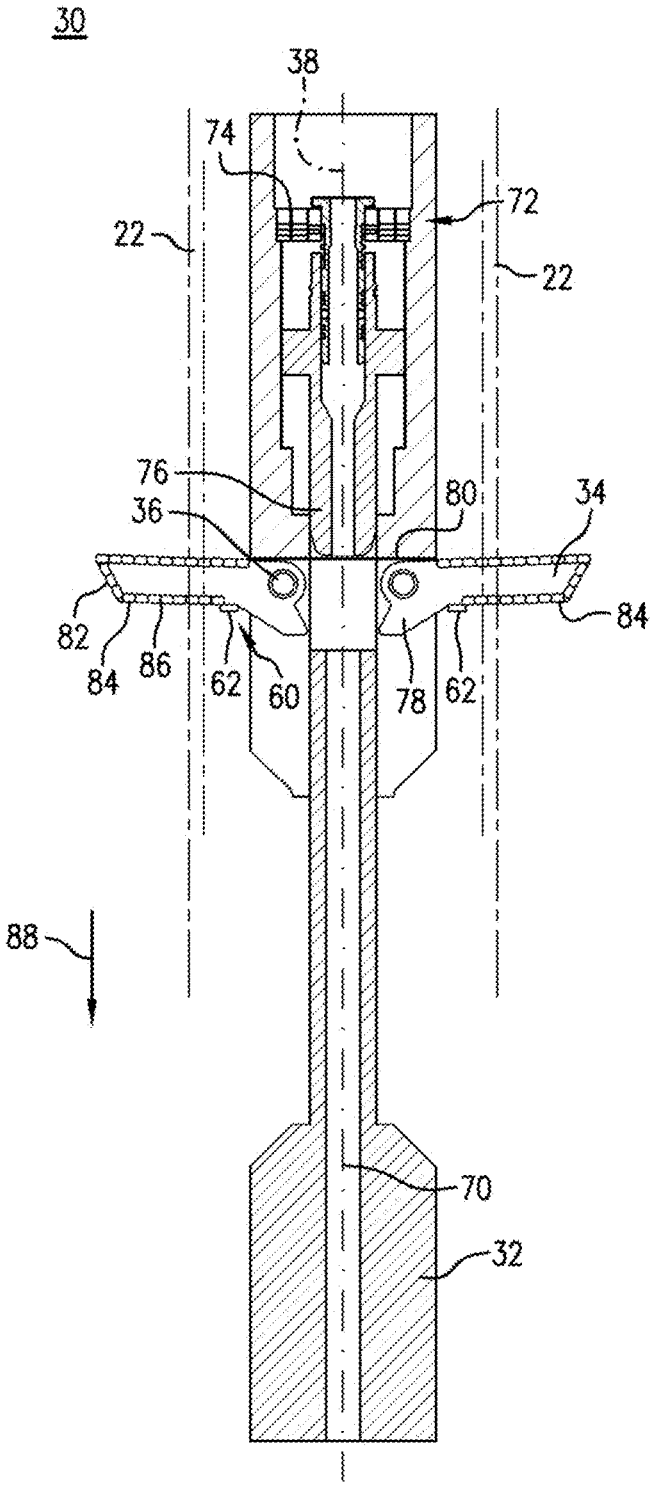
FIG. 3 depicts an embodiment of the milling apparatus of FIGS. 1 and 2 in an open position.

To move the milling knives 34 to the open position, shown in FIG. 3, the hydraulic actuator 74 is operated to move the actuator member 76 in an axial direction and engage an end of each milling knife 34. In one embodiment, each milling knife includes a profile portion or other engagement feature 78 that is engaged by the actuator member 76 to move the milling knives 34.

Each milling knife 34 has an elongated body having a first or inner end 80 and a second or outer end 82. A plurality of cutting elements, e.g., an array of cutting elements 84 such as carbide inserts, extend along the body between the first end 80 and the second end 82. In one embodiment, the array of cutting elements 84 extend at least along a surface 86 of the milling knife 34 that faces a cutting direction 88, and may also extend along a surface opposite the cutting direction.

As shown in FIG. 3, each milling knife 34 has a length selected so that the milling knife 34 extends to at least the outer casing 22 when in the open position. In the open position, the milling knife 34 may be fully open so that the milling knife 34 is normal to the central axis 38 (i.e., 90 degrees from the central axis) or at least partially normal (e.g., less than or greater than 90 degrees). For example, in the embodiment of FIG. 3, the milling knife 34 is opened so that the surface 86 is at a three degree angle from normal. In other examples, the milling knife 34 is configured to be opened to a position where the angle of the surface 86 is greater than 90 degrees from the central axis, which can aid stabilization of the milling tool 30, due to the negative slope of the knives 34 while sitting on top of the outer string of casing.

The automatic stabilization feature 60 includes a stabilization member 62 that is fixedly attached to each milling knife 34 (or at least one milling knife 34) and restricts lateral movement of the milling knife 34 during cutting or milling of the outer casing 22. The stabilization member 62 forms a mechanical stop so that if the milling knife 34 moves laterally beyond a selected amount, the stabilization member 62 contacts the outer casing 22 and prevents the milling knife 34 from moving further in the lateral direction.

In one embodiment, as shown in FIGS. 2 and 3, the stabilization member 62 is attached to the surface 86 between the cutting elements 84 and the inner end 80. The stabilization member 62 may have any suitable length so that the stabilization member 62 extends within a gap between the housing 32 and the outer casing 22. The stabilization member 62 is configured so that the stabilization member 62 contacts the outer casing when in the open position or is disposed a selected lateral distance from an inner surface of the outer casing 22. For example, the stabilization member 62 is welded or otherwise permanently attached to the surface 86 and has a length that is less than or equal to the distance between the body 32 and the outer casing 22. In some embodiments, the stabilization member 62 is removably attached (e.g., via bolts or screws).

FIGS. 2 and 3 show an example of the dimensions of the outer casing 22 and the milling knives 34. It is noted that these dimensions are for illustrative purposes and are not intended to be limiting. In this example, the housing 32 has a diameter that is less than the inner diameter of the inner casing 24 so that the milling tool 30 can be run through the inner casing 24 and positioned at the window 54. The outer casing 22 has an outer diameter of about 13.625 inches and an inner diameter of 12.375 inches. The milling knife 34 has an overall length of about 8.25 inches and extends about 10.9 inches from the central axis 38 when in the open position. The stabilization member 62 is fixedly attached to the surface 86 so that there is about a 0.67 inch clearance from the inner surface of the outer casing 22.

Figure 4:
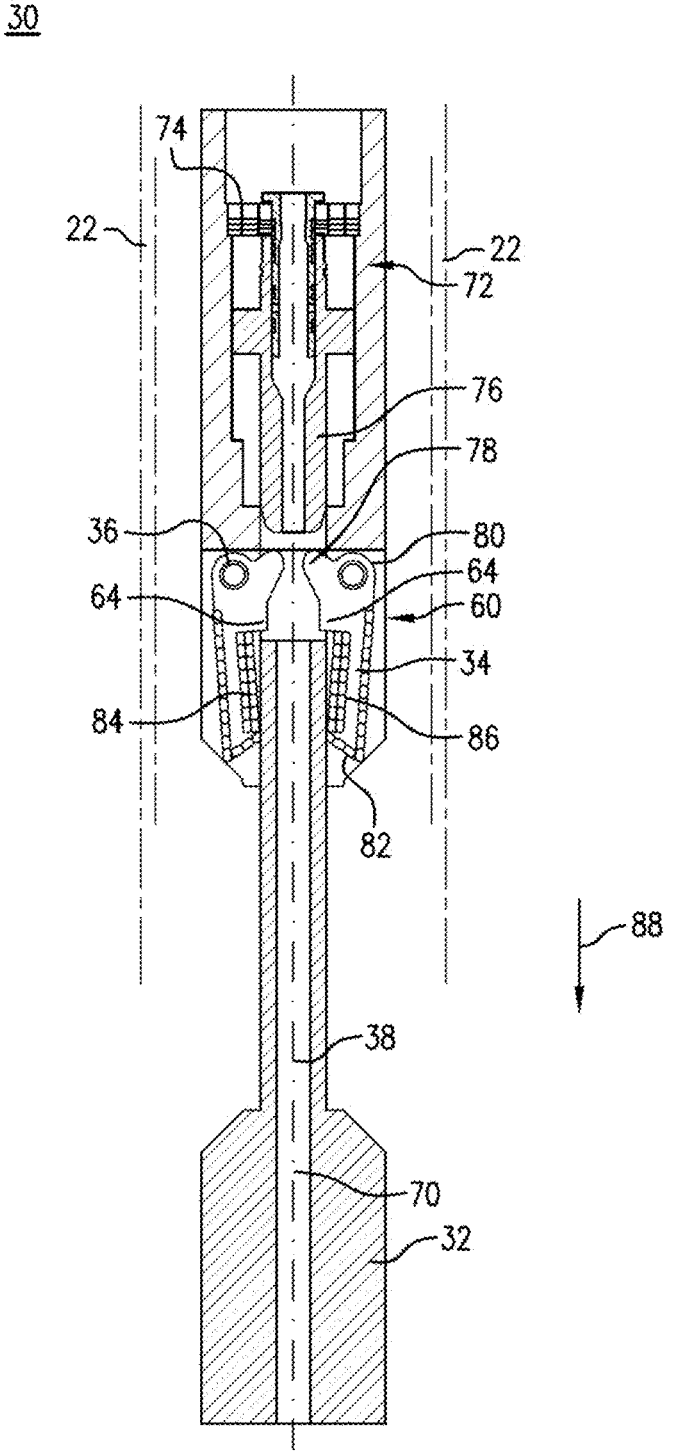
FIG. 4 depicts an embodiment of the milling apparatus of FIG. 1 in a closed position.
Figure 5:
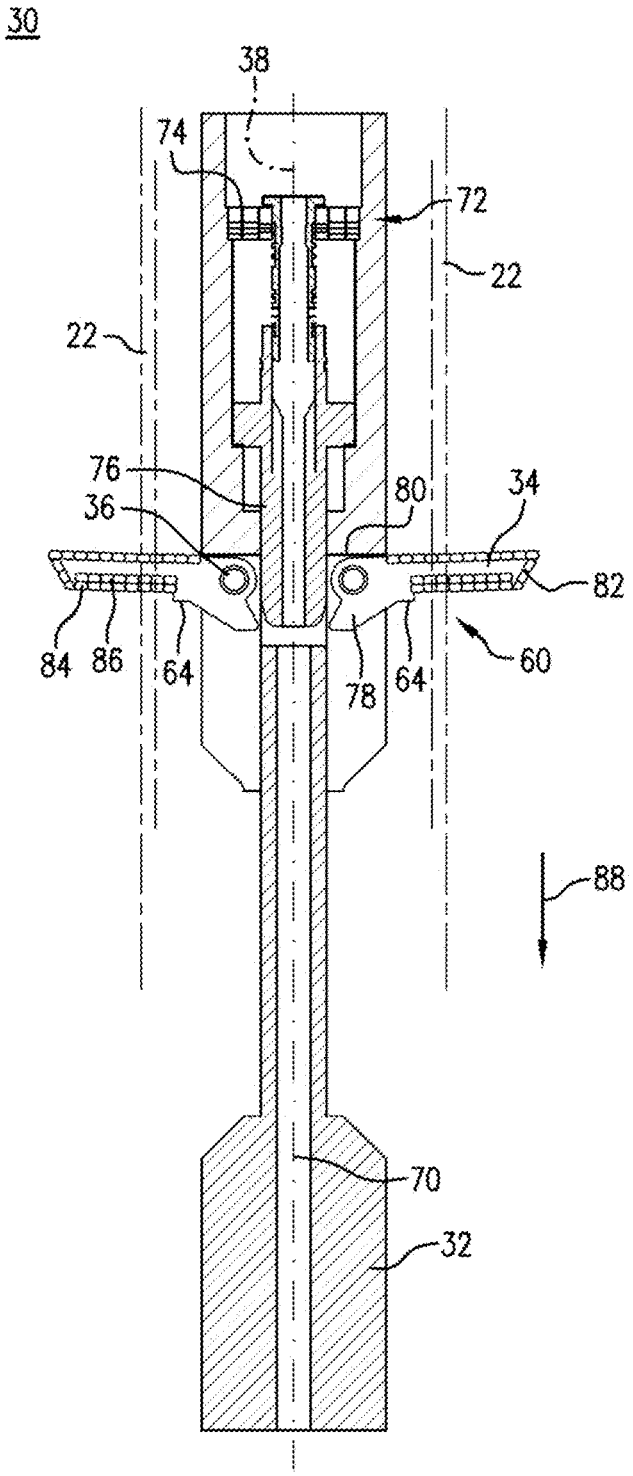
FIG. 5 depicts an embodiment, of the milling apparatus of FIGS. 1 and 4 in an open position.

FIGS. 4 and 5 show another embodiment of the milling tool 30. This embodiment is similar to the embodiment of FIGS. 2 and 3, except that the array of cutting elements 84 form multiple rows on the milling knife 34. In addition, in this embodiment, the stabilization feature includes a stabilization member 64 formed by the body of the milling knife 34. In one embodiment, the stabilization member is a shoulder 64 formed on or near the surface 86. The shoulder 64 is configured to form a mechanical stop between the housing 32 and the outer casing 24, and functions similar to the stabilization member 62.

The milling tool 30 and/or other components may be included in or embodied as a BHA, drill string component or other suitable carrier. A "carrier" as described herein means any device, device component, combination of devices, media and/or member that may be used to convey, house, support or otherwise facilitate the use of another device, device component, combination of devices, media and/or member. Exemplary non-limiting carriers include drill strings of the coiled tubing type, of the jointed pipe type and any combination or portion thereof. Other carrier examples include casing pipes, wirelines, wireline sondes, slickline sondes, drop shots, downhole subs, bottom-hole assemblies, and drill strings.

Figure 6:
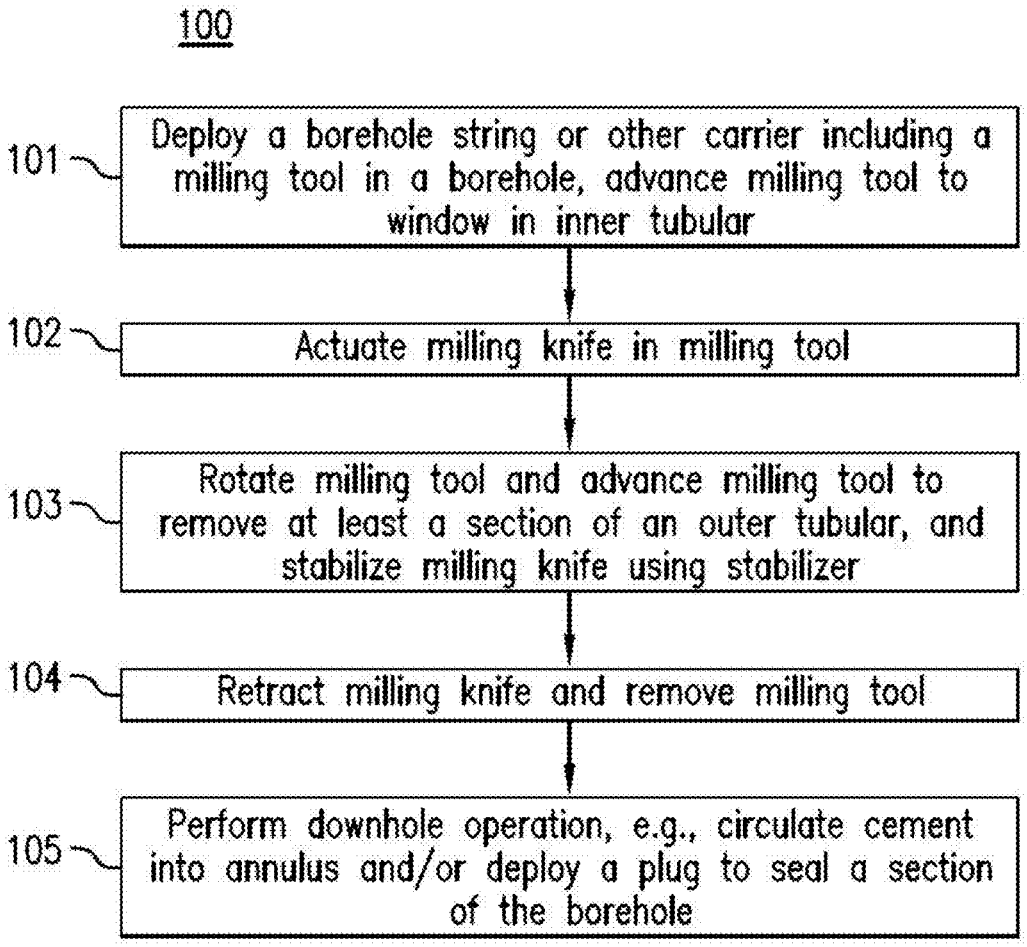
FIG. 6 is a flow chart depicting an embodiment of a method of milling a downhole tubular and/or performing an energy industry operation.

FIG. 6 illustrates a method 100 of milling a downhole component and/or performing an energy industry operation. The method 100 may be performed in conjunction with the system 10, but is not limited thereto. Aspects of the method 100 may be performed by a processor such as the surface processing unit 48 and/or the downhole processor 46, either automatically or through input by a human operator.

The method 100 is discussed in conjunction with a plug and abandonment (P&A) operation for illustration purposes. However, the method 100 is not so limited and can be used in conjunction with any energy industry operation in which milling is desired.

The method 100 includes one or more of stages 101-105 described herein, at least portions of which may be performed by a processor, such as the surface processing unit 48. In one embodiment, the method 100 includes the execution of all of stages 101-105 in the order described. However, certain stages 101-105 may be omitted, stages may be added, or the order of the stages changed.

In the first stage 101, a borehole string 12 or other carrier including the milling tool 30 is deployed into the borehole 14 having a plurality of tubulars disposed therein. For example, the milling tool 30 is deployed through the inner casing 24 and positioned at an axial location that corresponds to the window 54 that was previously cut from the inner casing 24.

In the second stage 102, the milling tool 30 is operated by actuating one or more milling knives 34. For example, each milling knife 34 is actuated, e.g., by the hydraulic actuator 74, to rotate the milling knife 34 about the pivot point 36 and extend the milling knife 34 through the window 54 and into an annulus between the inner casing 24 and the outer casing 22. In this stage, the milling tool 34 accomplishes at least two functions: the first to make cut out (penetration) on the outer casing 22, and the second to mill the outer casing in an axial direction.

In the third stage 103, the milling tool 30 is rotated by a surface drive or a mud motor and advanced in an axial cutting direction. For example, the milling tool 30 is advanced along the borehole 12 away from the surface. In some instances, the milling tool 30 can be advanced toward the surface. As the milling tool 30 is advanced and grinds or cuts away the outer casing 22, fluid is circulated through the borehole string 12 and the annulus to remove cuttings.

During operation of the milling tool 30, the automatic stabilization feature 60 reduces or eliminates lateral vibration or wobbling by reducing or substantially eliminating the gap between the tool housing 32 and the outer casing 22. If a milling knife 34 moves laterally beyond a selected distance, the stabilization feature 60 can contact the outer casing 22 during the milling operation to restrict an amount of lateral movement of the milling knife 34.

The automatic stabilization feature 60 can be used with or without additional stabilizers, such as stabilizers hanging from the bottom of the tool 30 and/or above the tool 30. Such additional stabilizers may be solid, or of the hydraulic expandable type.

During a milling operation, the milling knives 34 are advanced axially in a cutting direction as they cut/mill or grind away the outer casing 22. The stabilization feature (e.g., the stabilization member 62 or the shoulder 64) is positioned on one or more of the milling knives 34 so that the stabilization feature 60 leads the cutting surface (e.g., the surface 86) during the milling operation. In this way, the milling knives 34 are laterally restricted by the outer casing 22 during the milling operation. The stabilization feature 60 may have varying contours that contact the inside diameter of the outer casing 22, such as a radius that matches or very closely matches the inside diameter of the outer casing 22.

In the fourth stage 104, after milling the section of the outer casing 22 is complete, the milling knives 34 are retracted and the milling tool 30 is pulled out of the borehole.

In the fifth stage 105, aspects of an energy industry operation are performed. For example, cement may be circulated through the borehole 12 to the section of annulus between the inner casing and the outer casing to seal off the annulus.

The milling of the inner casing 24 may be performed using the milling tool 30 or using another milling tool, e.g., a milling tool having milling knives configured for the inner casing (having a smaller length than the milling knives 34). In addition, although only two tubulars are described in conjunction with the method 100, the method 100 can be used to cut multiple tubulars. For example, the method 100 may also include similarly milling an additional component (e.g., another casing) through a second window formed in the outer casing 22.

The systems and methods described herein provide various advantages over prior art techniques. For example, the milling apparatus and stabilization feature restricts or eliminates lateral movement (e.g., lateral vibration and wobbling) while milling a tubular. For example, the milling apparatus can be used to mill a secondary window through a restricted borehole using mechanical tools, without requiring complex and costly stabilizing features such as hydraulically driven stabilizers and/or hangers.

Set forth below are some embodiments of the foregoing disclosure:

Embodiment 1

An apparatus for removing at least a section of a tubular, including: an axially elongated body configured to be advanced through an inner tubular in a borehole in an earth formation to a selected location, the inner tubular disposed within an outer tubular in the borehole and having a diameter that is less than a diameter of the outer tubular; and a cutter configured to be actuated between a closed position in which the cutter is disposed within the body and an open position in which the cutter extends radially, the cutter having a length sufficient to engage and cut the outer tubular, the cutter configured to be advanced in an axial cutting direction as the outer tubular is cut; and an automatic stabilization member disposed on the cutter, the stabilization member configured to restrict lateral movement of the cutter by contacting the outer tubular during cutting of the outer tubular.

Embodiment 2

The apparatus as in any prior embodiment, wherein the selected location corresponds to a first window in the inner tubular, and the cutter extends through the window when the cutter is in the open position.

Embodiment 3

The apparatus as in any prior embodiment, wherein the stabilization member extends laterally along the cutter when the cutter is in the open position, and has a length that is less than or equal to a distance between the body and the outer tubular when the body is disposed at the selected location.

Embodiment 4

The apparatus as in any prior embodiment, wherein the stabilization member contacts the outer tubular during cutting based on the cutter moving laterally to restrict an amount of lateral movement of the cutter.

Embodiment 5

The apparatus as in any prior embodiment, wherein the stabilization member is attached to the cutter so that the stabilization member leads a cutting surface of the cutter as the cutter advances in the cutting direction.

Embodiment 6

The apparatus as in any prior embodiment, wherein the cutter has an inner end disposed in the body and an outer end that is disposed in an annulus of the borehole when in the open position, the cutter having an array of cutting elements along a surface of the cutter between the inner end and the outer end that faces the cutting direction.

Embodiment 7

The apparatus as in any prior embodiment, wherein the stabilization member forms a mechanical stop located at the surface of the cutter between the inner end and the outer tubular when the cutter is in the open position.

Embodiment 8

The apparatus as in any prior embodiment, wherein the stabilization member is fixedly disposed at the surface of the cutter between the inner end of the cutter and the array of cutting elements.

Embodiment 9

The apparatus as in any prior embodiment, wherein the stabilization member is a component permanently attached to the surface between the inner end of the cutter and the array of cutting elements.

Embodiment 10

The apparatus as in any prior embodiment, wherein the stabilization member is a shoulder formed at the surface.

Embodiment 11

The apparatus as in any prior embodiment, wherein the cutter is rotatable about a pivot point in the body to move the cutter between the open position and the closed position.

Embodiment 12

A method of removing at least a section of a tubular, including: advancing an apparatus having an axially elongated body through an inner tubular in a borehole in an earth formation to a selected location, the inner tubular disposed within an outer tubular in the borehole and having a diameter that is less than a diameter of the outer tubular, the apparatus having a cutter; actuating the cutter from a closed position in which the cutter is disposed within the body and an open position in which the cutter extends radially, the cutter having a length sufficient to engage and cut the outer tubular, the cutter having an automatic stabilization member disposed on the cutter to restrict lateral movement of the cutter during cutting of the outer tubular; rotating the apparatus and advancing the cutter in an axial cutting direction to remove at least a section of the outer tubular, and restricting lateral movement of the cutter by the stabilization member by contacting the outer tubular during cutting of the outer tubular.

Embodiment 13

The method as in any prior embodiment, wherein the selected location corresponds to a first window in the inner tubular, and the cutter extends through the first window when the cutter is in the open position.

Embodiment 14

The method as in any prior embodiment, wherein the stabilization member extends laterally along the cutter when the cutter is in the open position, and has a length that is less than or equal to a distance between the body and the outer tubular when the body is disposed at the selected location.

Embodiment 15

The method as in any prior embodiment, wherein the stabilization member contacts the outer tubular during cutting based on the cutter moving laterally to restrict an amount of lateral movement of the cutter.

Embodiment 16

The method as in any prior embodiment, wherein the stabilization member is attached to the cutter so that the stabilization member leads a cutting surface of the cutter as the cutter advances in the cutting direction.

Embodiment 17

The method as in any prior embodiment, wherein the cutter has an inner end disposed in the body and an outer end that is disposed in an annulus of the borehole when in the open position, the cutter having an array of cutting elements along a surface of the cutter between the inner end and the outer end that faces the cutting direction.

Embodiment 18

The method as in any prior embodiment, wherein the stabilization member is fixedly disposed at the surface of the cutter between the inner end of the cutter and the array of cutting elements.

Embodiment 19

The method as in any prior embodiment, wherein the stabilization member is a shoulder formed at the surface.

Embodiment 20

The method as in any prior embodiment, wherein actuating the cutter includes rotating the cutter about a pivot point in the body to move the cutter between the open position and the closed position.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An apparatus for removing at least a section of a tubular, comprising:

an axially elongated body configured to be advanced through an inner tubular in a borehole in an earth formation to a selected location, the inner tubular disposed within an outer tubular in the borehole and having a diameter that is less than a diameter of the outer tubular; and a cutter including a cutter body and one or more cutting elements disposed at a first location along a surface of the cutter body, the surface configured to face an axial cutting direction, the cutter configured to be actuated between a closed position in which the cutter is disposed within the body and an open position in which the cutter extends radially, the cutter having a length sufficient to engage and cut the outer tubular, the cutter configured to be advanced in an axial cutting direction as the outer tubular is cut; and an automatic stabilization member disposed at the surface of the cutter and disposed at a location that is radially inward from the first location in the open position, the stabilization member configured to restrict lateral movement of the cutter and prevent lateral movement beyond a selected distance by contacting the outer tubular during cutting of the outer tubular, the stabilization member configured to lead the one or more cutting elements during the cutting of the outer tubular.

2. The apparatus of claim 1, wherein the selected location corresponds to a first window in the inner tubular, and the cutter extends through the window when the cutter is in the open position.

3. The apparatus of claim 1, wherein the stabilization member extends laterally along the cutter when the cutter is in the open position, and has a length that is less than or equal to a distance between the body and the outer tubular when the body is disposed at the selected location.

4. The apparatus of claim 1, wherein the stabilization member contacts the outer tubular during cutting based on the cutter moving laterally to restrict an amount of lateral movement of the cutter.

5. The apparatus of claim 1, wherein the stabilization member is attached to the cutter so that the stabilization member leads a cutting surface of the cutter as the cutter advances in the cutting direction.

6. The apparatus of claim 1, wherein the cutter has an inner end disposed in the body and an outer end that is disposed in an annulus of the borehole when in the open position, the cutter having an array of cutting elements along a surface of the cutter between the inner end and the outer end that faces the cutting direction.

7. The apparatus of claim 6, wherein the stabilization member forms a mechanical stop located at the surface of the cutter between the inner end and the outer tubular when the cutter is in the open position.

8. The apparatus of claim 6, wherein the stabilization member is fixedly disposed at the surface of the cutter between the inner end of the cutter and the array of cutting elements.

9. The apparatus of claim 6, wherein the stabilization member is a component permanently attached to the surface between the inner end of the cutter and the array of cutting elements.

10. The apparatus of claim 6, wherein the stabilization member is a shoulder formed at the surface.

11. The apparatus of claim 1, wherein the cutter is rotatable about a pivot point in the body to move the cutter between the open position and the closed position.

12. A method of removing at least a section of a tubular, comprising:

advancing an apparatus having an axially elongated body through an inner tubular in a borehole in an earth formation to a selected location, the inner tubular disposed within an outer tubular in the borehole and having a diameter that is less than a diameter of the outer tubular, the apparatus having a cutter including a cutter body and one or more cutting elements disposed at a first location along a surface of the cutter body, the surface configured to face an axial cutting direction;

actuating the cutter from a closed position in which the cutter is disposed within the body and an open position in which the cutter extends radially, the cutter having a length sufficient to engage and cut the outer tubular, the cutter having an automatic stabilization member disposed at the surface of the cutter to restrict lateral movement of the cutter and prevent lateral movement beyond a selected distance during cutting of the outer tubular, the stabilization member disposed at a location that is radially inward from the first location in the open position;

rotating the apparatus and advancing the cutter in an axial cutting direction to remove at least a section of the outer tubular, and restricting lateral movement of the cutter by the stabilization member by contacting the outer tubular during cutting of the outer tubular, the stabilization member leading the one or more cutting elements during the advancing.

13. The method of claim 12, wherein the selected location corresponds to a first window in the inner tubular, and the cutter extends through the first window when the cutter is in the open position.

14. The method of claim 12, wherein the stabilization member extends laterally along the cutter when the cutter is in the open position, and has a length that is less than or equal to a distance between the body and the outer tubular when the body is disposed at the selected location.

15. The method of claim 12, wherein the stabilization member contacts the outer tubular during cutting based on the cutter moving laterally to restrict an amount of lateral movement of the cutter.

16. The method of claim 12, wherein the stabilization member is attached to the cutter so that the stabilization member leads a cutting surface of the cutter as the cutter advances in the cutting direction.

17. The method of claim 12, wherein the cutter has an inner end disposed in the body and an outer end that is disposed in an annulus of the borehole when in the open position, the cutter having an array of cutting elements along a surface of the cutter between the inner end and the outer end that faces the cutting direction.

18. The method of claim 17, wherein the stabilization member is fixedly disposed at the surface of the cutter between the inner end of the cutter and the array of cutting elements.

19. The method of claim 17, wherein the stabilization member is a shoulder formed at the surface.

20. The method of claim 12, wherein actuating the cutter includes rotating the cutter about a pivot point in the body to move the cutter between the open position and the closed position.

* * * * *